US009533424B2

(12) United States Patent
Winter et al.

(10) Patent No.: US 9,533,424 B2
(45) Date of Patent: Jan. 3, 2017

(54) RAZOR HANDLE

(75) Inventors: Florina Winter, Shanghai (CN); Chunfang Song, Shanghai (CN); Dong Fang, Shanghai (CN); RanMin Wang, Shanghai (CN); Brian William Cataldo, Dorchester, MA (US); Jing Jun Xia, Shanghai (CN)

(73) Assignee: The Gillette Company LLC, Boston, MA (US)

( * ) Notice: Subject to any disclaimer, the term of this patent is extended or adjusted under 35 U.S.C. 154(b) by 650 days.

(21) Appl. No.: 13/551,109

(22) Filed: Jul. 17, 2012

(65) Prior Publication Data

US 2012/0279039 A1 Nov. 8, 2012

Related U.S. Application Data

(62) Division of application No. 12/323,503, filed on Nov. 26, 2008, now abandoned.

(51) Int. Cl.
*B26B 21/52* (2006.01)

(52) U.S. Cl.
CPC ..... *B26B 21/521* (2013.01); *B26B 21/522* (2013.01); *B26B 21/528* (2013.01); *Y10T 16/476* (2015.01); *Y10T 29/49* (2015.01); *Y10T 29/49826* (2015.01)

(58) Field of Classification Search
CPC ..... B26B 21/52–21/528; Y10T 16/476; Y10T 29/49; Y10T 29/49826
USPC ..... 30/526–536, 541; 16/430, DIG. 20, 16/DIG. 19, DIG. 12; 74/551.9
See application file for complete search history.

(56) References Cited

U.S. PATENT DOCUMENTS

| | | | | |
|---|---|---|---|---|
| 3,299,508 | A | | 1/1967 | Kuhnl |
| 3,311,975 | A | | 4/1967 | Longuyon |
| 4,026,016 | A | | 5/1977 | Nissen |
| 4,083,104 | A | | 4/1978 | Nissen et al. |
| 4,281,455 | A | | 8/1981 | Dixon et al. |
| 4,514,904 | A | | 5/1985 | Bond |
| 4,587,729 | A | | 5/1986 | Jacobson |
| 4,744,144 | A | | 5/1988 | Lowery, Sr. et al. |
| 4,785,534 | A | | 11/1988 | Lazarchik |
| 4,949,457 | A | * | 8/1990 | Burout, III ..... 30/526 |
| 5,027,511 | A | | 7/1991 | Miller |
| 5,031,319 | A | | 7/1991 | Althaus et al. |
| 5,070,614 | A | | 12/1991 | Hardin et al. |
| 5,261,665 | A | | 11/1993 | Downey |
| 5,331,740 | A | | 7/1994 | Carson, III et al. |
| 5,347,717 | A | | 9/1994 | Ts'ai |
| 5,544,415 | A | | 8/1996 | Huang |
| 5,822,869 | A | | 10/1998 | Metcalf et al. |
| 5,855,071 | A | | 1/1999 | Apprille, Jr. et al. |
| 5,890,296 | A | | 4/1999 | Metcalf et al. |

(Continued)

FOREIGN PATENT DOCUMENTS

WO WO-2005/077616 A1 8/2005

*Primary Examiner* — Laura M Lee
(74) *Attorney, Agent, or Firm* — John M. Lipchitz; Kevin C. Johnson; Steven W. Miller

(57) ABSTRACT

A razor handle includes an at least partially hollow elongated structure and an at least partially hollow sleeve. The elongated structure has an interior surface and an exterior surface, a first opening at a proximate end, and a second opening along a length of the elongated structure. The sleeve has an interior surface and an exterior surface with a protrusion. The protrusion is adapted to extend through the second opening to the exterior surface of the elongated structure forming a gripping member.

17 Claims, 13 Drawing Sheets

(56) References Cited

U.S. PATENT DOCUMENTS

| | | | | |
|---|---|---|---|---|
| RE36,816 | E | 8/2000 | Apprille, Jr. et al. | |
| 6,493,950 | B1 | 12/2002 | Kludjian et al. | |
| 6,588,113 | B2 | 7/2003 | Bozikis et al. | |
| 6,591,456 | B2 | 7/2003 | DeLuca et al. | |
| 6,694,626 | B2 | 2/2004 | Kludjian et al. | |
| 6,880,253 | B1 | 4/2005 | Gyllerstrom | |
| 7,004,655 | B2 | 2/2006 | Ferrara | |
| 7,028,405 | B2 | 4/2006 | Paas et al. | |
| 7,140,116 | B2 | 11/2006 | Coffin | |
| 7,347,121 | B2 | 3/2008 | Wu | |
| D568,000 | S | 4/2008 | Wonderley et al. | |
| 7,367,126 | B2 | 5/2008 | Freund et al. | |
| 7,805,845 | B2 | 10/2010 | Kludjian et al. | |
| 2004/0093735 | A1 | 5/2004 | Ohtsubo et al. | |
| 2004/0103545 | A1* | 6/2004 | Dansreau | 30/526 |
| 2005/0066532 | A1 | 3/2005 | Kludjian et al. | |
| 2005/0172493 | A1 | 8/2005 | Fischer et al. | |
| 2006/0242847 | A1 | 11/2006 | Dansreau et al. | |
| 2006/0283025 | A1 | 12/2006 | Follo et al. | |

* cited by examiner

RAZOR HANDLE

CROSS REFERENCE TO RELATED APPLICATIONS

This application is a divisional of U.S. application Ser. No. 12/323,503, filed on Nov. 26, 2008, now abandoned.

BACKGROUND

The invention relates to shaving systems having a handle and a replaceable cartridge.

Shaving systems often consist of a handle and a replaceable cartridge in which one or more blades are mounted in a plastic housing. After the blades in a cartridge have become dull from use, the cartridge is discarded, and replaced on the handle with a new cartridge. In some shaving systems, the blades are resiliently mounted with respect to the cartridge housing and deflect under the force of skin contact during shaving. In some shaving systems, the connection of the cartridge to the handle provides a pivotal mounting of the cartridge with respect to the handle so that the cartridge angle adjusts to follow the contours of the surface being shaved. In such systems, the cartridge can be biased toward an at rest position by the action of a spring-biased plunger (a cam follower) carried on the handle against a cam surface on the cartridge housing.

For example, U.S. Pat. No. 7,367,126 to Freund et al. and assigned to The Gillette Company discloses a powered wet-shaving razor having a grip and which is sold under the trade name Gillette® Fusion Power™. The grip tube is modular between the grip tube and base such that, when joined to one another a water-tight unit is formed prior to mounting of the razor head on the grip portion.

U.S. Pat. No. 4,514,904 to Michael Bond and assigned to The Gillette Company describes a razor, sold under the trade name Gillette® Atra® or Atra Plus®, that is attached by press fitting the housing member with the handle. However, the press fitting does not provide for a water-tight seal.

A need therefore exists to provide a low-cost razor, particularly a razor handle, with improved assemblies and that is generally impervious to liquids.

SUMMARY

In one aspect, the invention features, in general, a razor handle. The razor handle includes an at least partially hollow elongated structure and at least partially hollow sleeve. The elongated structure has an interior surface and exterior surface, a first opening at a proximate end, and a second opening along a length that extends from the interior surface to the exterior surface. The sleeve has an interior surface and exterior surface, including a protrusion that extends through the second opening to the exterior surface of the elongated structure forming a gripping member.

In another aspect the invention features, in general, a method of making a razor handle including providing an at least partially hollow elongated structure and at least partially hollow sleeve. The elongated structure has an interior surface and exterior surface, a first opening at a proximate end, and a second opening along a length that extends from the interior surface to the exterior surface. The sleeve has an interior surface and exterior surface, including a protrusion that extends through the second opening to the exterior surface of the elongated structure forming a gripping member.

Yet, in another aspect, the invention includes, in general, a shaving apparatus. The shaving apparatus includes an at least partially hollow elongated structure, an at least partially hollow sleeve, and a cartridge support structure. The elongated structure has an interior surface and exterior surface, a first opening at a proximate end, and a second opening along a length that extends from the interior surface to the exterior surface. The sleeve has an interior surface and exterior surface, including a protrusion that extends through the second opening to the exterior surface of the elongated structure forming a gripping member. The cartridge support structure includes top and bottom portions and proximate and distal ends. The proximate end of the cartridge support structure is adapted to engagably mate with the proximate end of the elongated structure and the distal end is adapted to releasably engage a razor cartridge.

Features of the invention may have one or more of the following advantages. The component parts allow for faster cycle times and, thus lower manufacturing costs over more commonly known handles of similar size and ergonomics.

Other features and advantages of the invention will be apparent from the description and drawings, and from the claims.

DETAILED DESCRIPTION

Figure 1:
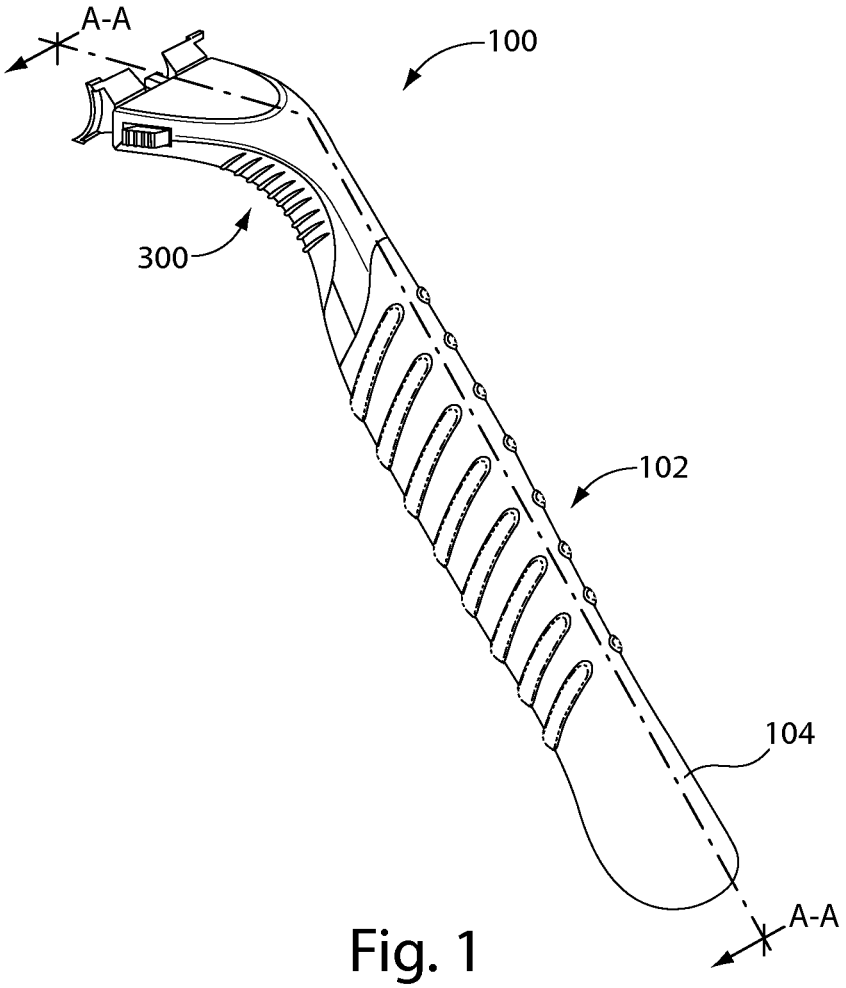
FIG. 1 is a perspective view of a shaving apparatus.

Referring to the drawings, FIGS. 1-4 show a shaving apparatus 100 including a handle 102 and a cartridge support structure 300. The handle 102 includes an at least partially hollow elongated structure 104. The elongated structure 104 has an interior surface 106, an exterior surface 108, a first opening 110 on a proximate end 112, and a second opening 116 along the length that extends from the interior surface 106 to the exterior surface 108. In an embodiment, the elongated structure has an additional opening 120 at the distal end 114. Alternatively, the elongated structure 104 may have multiple openings along the length 116*b*, 116*c*. In another embodiment, the elongated structure 104 also includes a corresponding groove 118 for engagably mating with a rib 312 on the cartridge support structure 300.

The elongated structure 104 may comprise a polymeric material selected from the group consisting of polystyrene, polypropylene, acrylonitrile butadiene styrene, acrylics, ethylene-vinyl acetate, ethylene vinyl alcohol, fluoroplastic, polyacetal, polyacrylate, polyacrylonitrile, polyamide, polyamide-imide, polyaryletherketone, polybutadiene, polybutylene, polybutylene terephthalate, polyethylene terephthalate, polycarbonate, polyketone, polyester, polyethylene, polyetheretherketone, polyetherimide, polysulfone, polyimide, polyphenylene, polysulfone, polyvinyl chloride, polyvinylidene chloride, thermoplastics, elastomers, and combinations thereof. In particular, a suitable polystyrene is Supreme SH731H2YG High Impact Polystyrene (HIPS) from The Supreme Industries Limited.

Figure 2A:
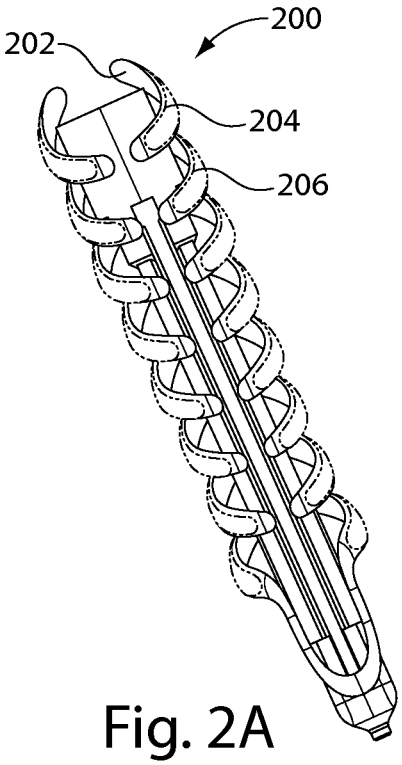
FIG. 2A is a perspective view of the at least partially hollow sleeve.
Figure 2B:
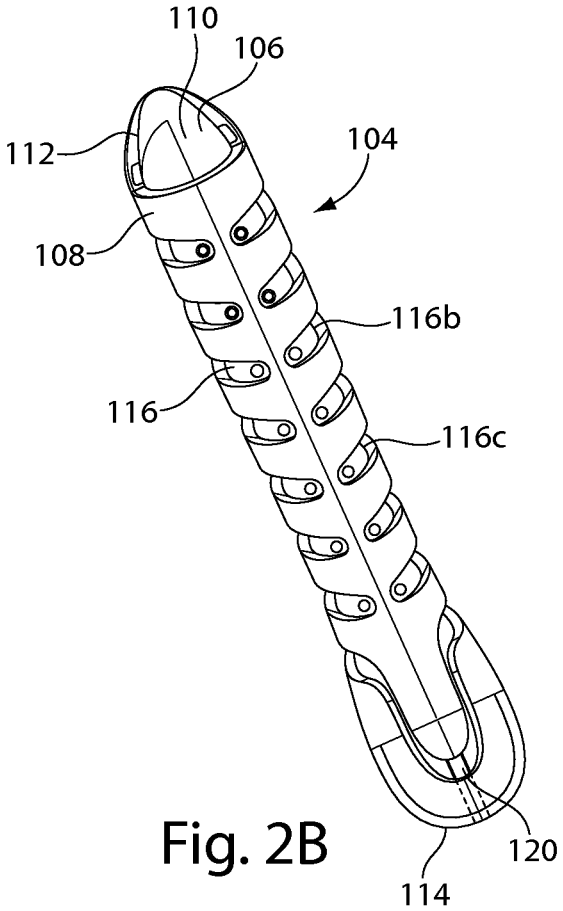
FIG. 2B is a perspective view of the at least partially hollow elongated structure.

As shown in FIGS. 2A and 2B, the handle 102 includes an at least partially hollow sleeve 200 located within the elongated structure 104. Sleeve 200 has an interior surface 202 and exterior surface 204. Handle 102 has a gripping member that is formed from protrusion 206 located on exterior surface 204 that extends through opening 116. In an embodiment, sleeve 200 also includes a corresponding groove 208 for engagably mating with a rib 312 on the cartridge support structure 300.

Sleeve 200 may contain a polymeric material selected from the group consisting of polystyrene, polypropylene, acrylonitrile butadiene styrene, acrylics, ethylene-vinyl acetate, ethylene vinyl alcohol, fluoroplastic, polyacetal, polyacrylate, polyacrylonitrile, polyamide, polyamide-imide, polyaryletherketone, polybutadiene, polybutylene, polybutylene terephthalate, polyethylene terephthalate, polycarbonate, polyketone, polyester, polyethylene, polyetheretherketone, polyetherimide, polysulfone, polyimide, polyphenylene, polysulfone, polyvinyl chloride, polyvinylidene chloride, thermoplastics, elastomers, and combinations thereof. In particular, a suitable elastomer is Kraiburg elastomer HTA8721/10 from Kraiburg TPE.

The handle 102 is made by providing an elongated structure 104 and sleeve 200. Typically, a polymeric material is molded forming the elongated structure 104 having opening 110 and opening 116. A polymeric material is injection molded into opening 110 forming sleeve 200 with protrusion 206, which extends out opening 116. In another implementation, elongated structure 104 has a second opening 120. The polymeric material is similarly injected into opening 120 forming sleeve 200 with protrusion 206, which extends out opening 116. In another implementation, the polymeric material is injected into opening 116 forming sleeve 200 with protrusion 206, which extends out opening 116.

For example, handle 102 can be made by heating a polymeric material, such as Supreme SH731H2YG HIPS, to approximately 220° C. The polymer is transferred into a mold having an elongated structure core pin. The polymer flows into the mold and once cooled forms the elongated structure 104 having openings 110, 116, and 120. The elongated structure 104 can then be removed from the mold and separated from the elongated structure core pin. An elastomer core pin is inserted into the elongated structure 104. An elastomeric material, such as Kraiburg elastomer HTA8721/10, is heated to approximately 190° C. This elastomeric material can be injected into opening 120 and flows along elastomer core pin and out openings 110 and 116. As the elastomeric material cools, sleeve 200 forms within elongated structure 104 having protrusion 206 extending through opening 116.

Figure 3:
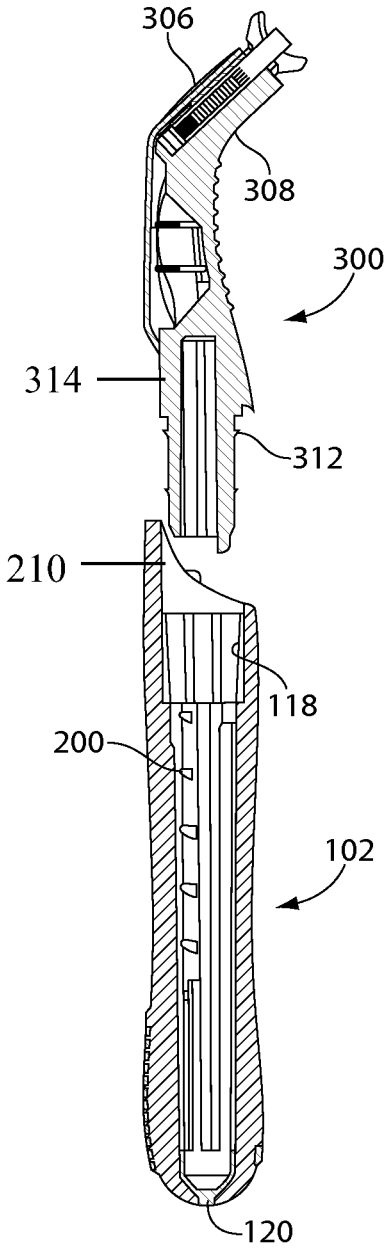
FIG. 3 is a cross-sectional view along line A-A of FIG. 1 of the shaving apparatus with a cartridge support structure separated from the handle.
Figure 4:
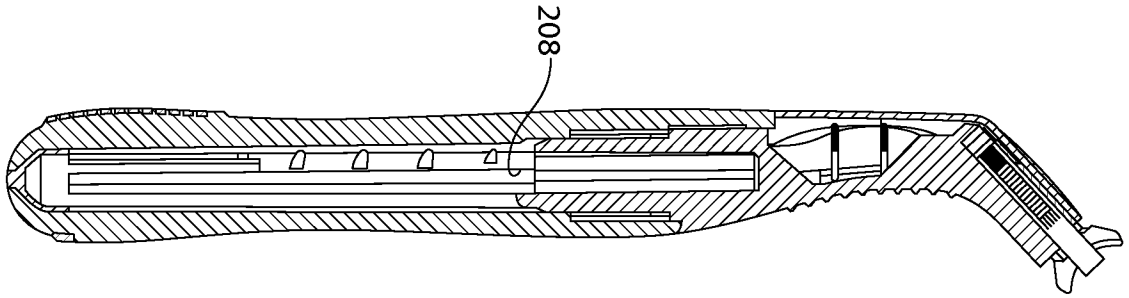
FIG. 4 is a cross-sectional view along line A-A of FIG. 1 shaving apparatus.
Figure 5:
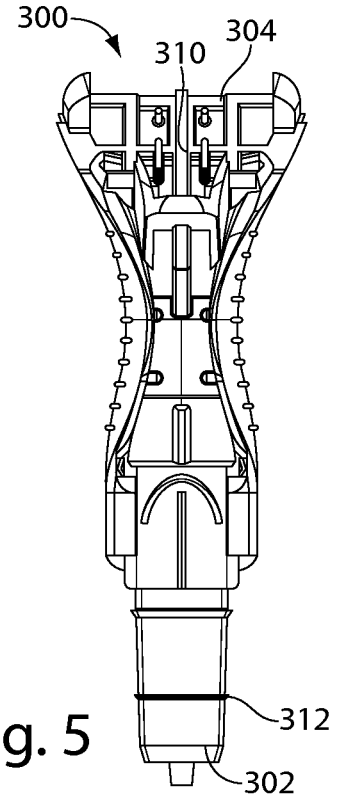
FIG. 5 is a top view of the cartridge support structure with the connecting assembly and top portion removed.

FIG. 3 shows the cartridge support structure 300 having a proximate end 302, a distal end 304, a top portion 306, a bottom portion 308, and connecting assembly 400. FIG. 5 shows the cartridge support structure with the top portion 306 and connecting assembly 400 removed. Proximate end 302 is adapted to engagably mate with the proximate end 112 of the elongated structure 104, as shown in FIG. 4. In an embodiment, shown in FIG. 3, the cartridge support structure 300 includes rib 312 for engagably mating with groove 118. In another embodiment, rib 314 engagably mates with groove 210. In another embodiment, shown in FIG. 4, rib 312 engagably mates with groove 208. Joining handle 102 with the cartridge support structure 300 renders the handle 102 impervious to liquid. The cartridge support structure 300 can be joined to handle 102 by interference fit, ultrasonic welding, glue, screws, snap-fit, spin welding, or other methods suitable for the intended purpose.

Figure 6:
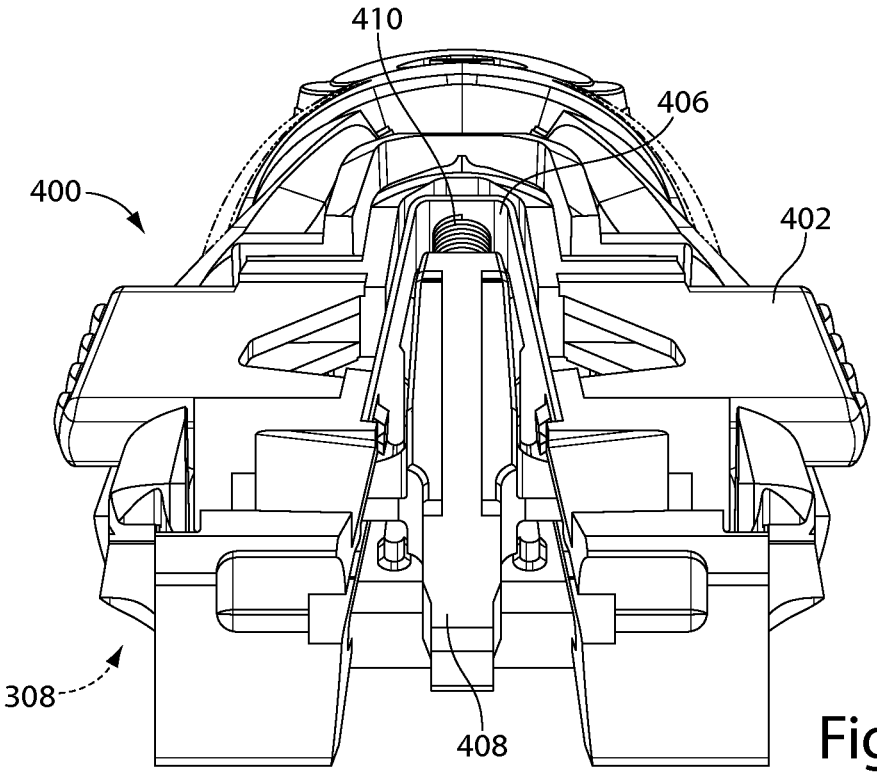
FIG. 6 is a front view of the connecting assembly within the cartridge support structure having the top portion removed.

Distal end 304 of the cartridge support structure 300 is adapted to releasably engage a razor cartridge (not shown). In an embodiment, top portion 306, shown in FIG. 3, is removable, as shown in FIG. 6. Recess 310, shown in FIG. 5, is adapted to receive connecting assembly 400, shown in FIG. 6. FIG. 6 shows the connecting assembly 400 that is located within recess 310 of the cartridge support structure 300, shown in FIG. 5, between the top portion 306 (not shown) and bottom portion 308.

Figure 7A:
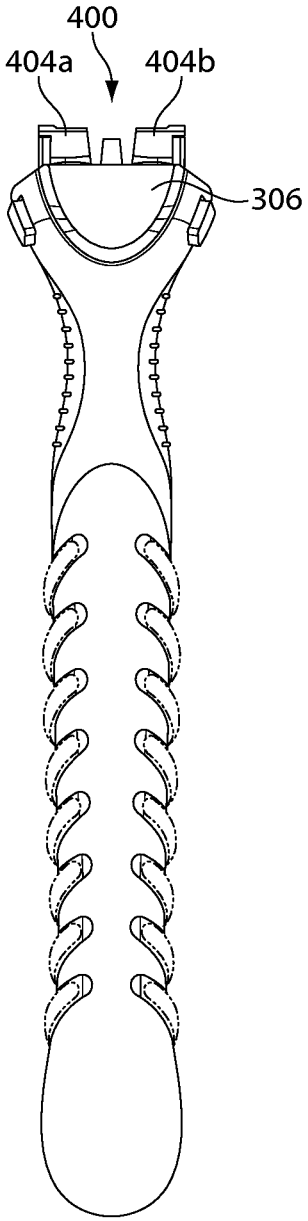
FIG. 7A is a perspective view of the shaving apparatus in the first position.
Figure 7B:
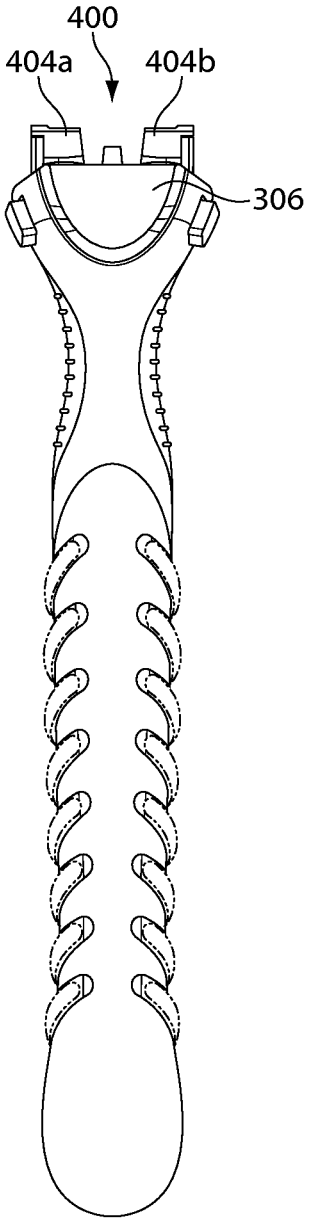
FIG. 7B is a perspective view of the shaving apparatus in the second position.
Figure 8:
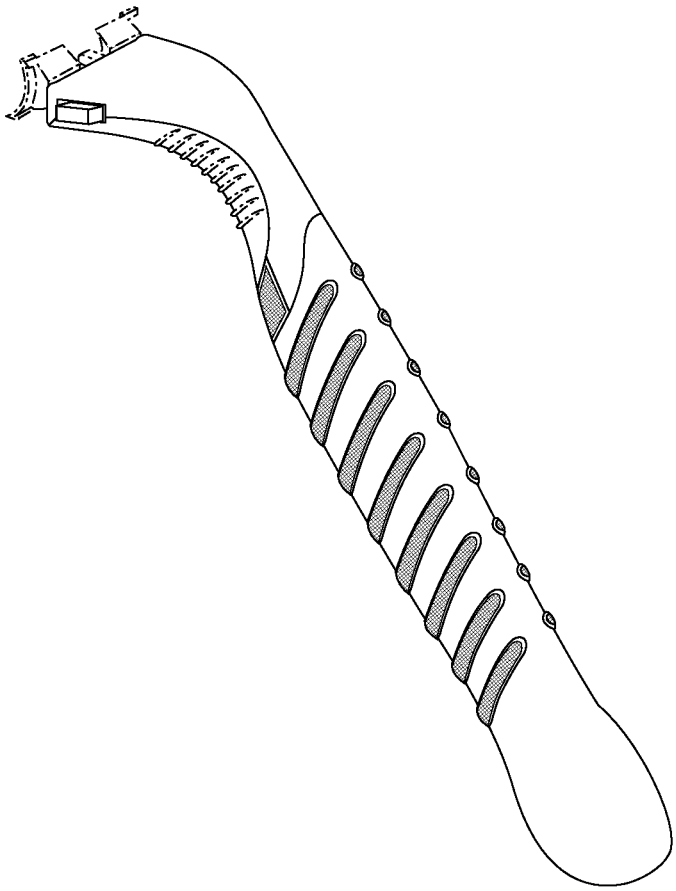
FIG. 8 is a perspective view of the shaving apparatus.
Figure 9:
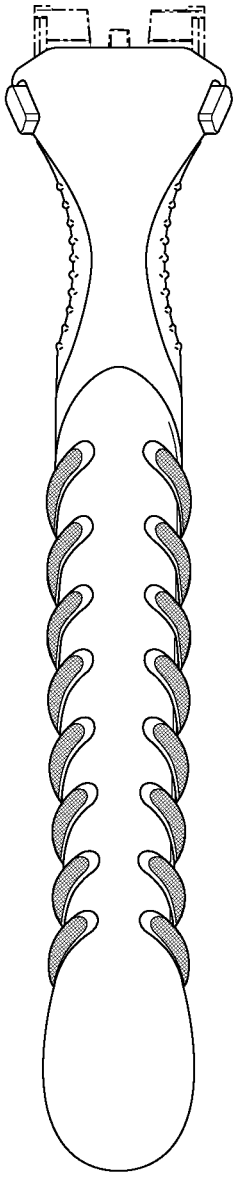
FIG. 9 is a top perspective view of the shaving apparatus.
Figure 10:
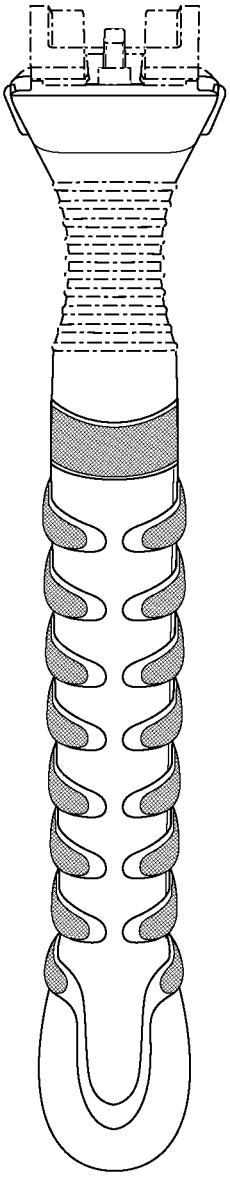
FIG. 10 is a bottom perspective view of the shaving apparatus.
Figure 11:
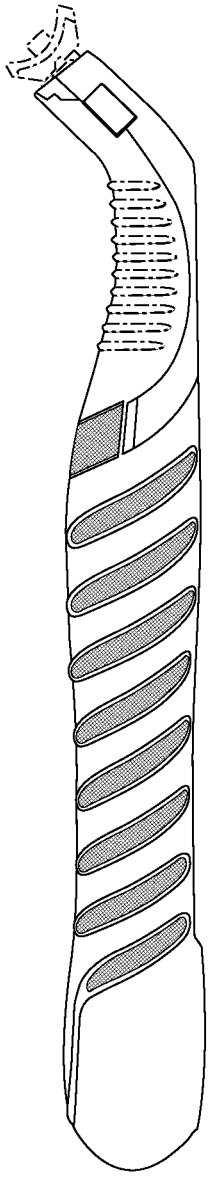
FIG. 11 is a side perspective view of the shaving apparatus.
Figure 12:
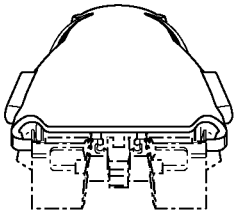
FIG. 12 is a front end view of the shaving apparatus.
Figure 13:
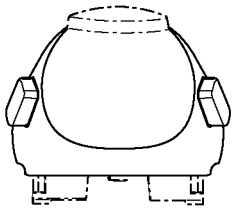
FIG. 13 is a rear end view of the shaving apparatus.
Figure 14:
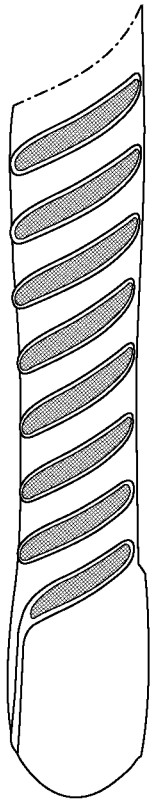
FIG. 14 is a side perspective view of a razor handle.
Figure 15:
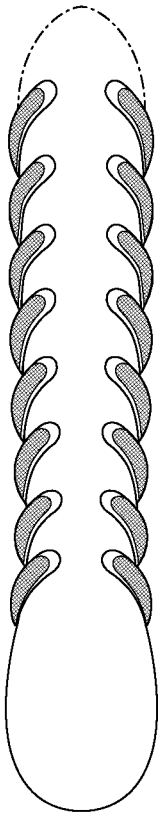
FIG. 15 is a top perspective view of the razor handle.
Figure 16:
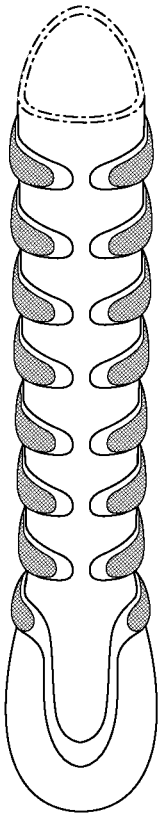
FIG. 16 is a bottom perspective view of the razor handle.
Figure 17:
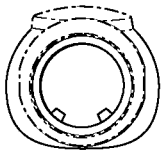
FIG. 17 is a front end view of the razor handle.
Figure 18:
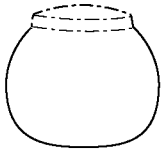
FIG. 18 is a rear end view of the razor handle.

In an embodiment, the connecting assembly 400 includes bearing button 402, a generally U-shaped bracket 406, cam follower 408, and spring 410. Bearing button 402 has movable members 404*a*, 404*b* for engaging a razor cartridge (not shown). Connecting assembly 400 is adapted to engage or disengage the razor cartridge. In a first position, shown in FIG. 7A, movable members 404*a*, 404*b* move toward each other allowing disengagement with the razor cartridge. In a second position, shown in FIG. 7B, movable members, 404*a*, 404*b* move away from each other permitting engagement with the razor cartridge. In an embodiment, connecting assembly 400 releasably engages movable members 404*a*, 404*b* by receiving a predetermined force from the razor cartridge causing the movable members 404*a*, 404*b* to move to the second position.

Top portion 306 may be made from the group consisting of polystyrene, polypropylene, acrylonitrile butadiene styrene, acrylics, ethylene-vinyl acetate, ethylene vinyl alcohol, fluoroplastic, polyacetal, polyacrylate, polyacrylonitrile, polyamide, polyamide-imide, polyaryletherketone, polybutadiene, polybutylene, polybutylene terephthalate, polyethylene terephthalate, polycarbonate, polyketone, polyester, polyethylene, polyetheretherketone, polyetherimide, polysulfone, polyimide, polyphenylene, polysulfone, polyvinyl chloride, polyvinylidene chloride, thermoplastics, elastomers, metal, metal alloy, and combinations thereof. In particular, top portion 306 is made of Supreme SH731H2YG HIPS or an aluminum or aluminum alloy material.

Bearing button 402 and cam follower 408 may comprise a polymeric material selected from the group consisting polypropylene, acrylonitrile butadiene styrene, acrylics, ethylene-vinyl acetate, ethylene vinyl alcohol, fluoroplastic, polyacetal, polyacrylate, polyacrylonitrile, polyamide, polyamide-imide, polyaryletherketone, polybutadiene, polybutylene, polybutylene terephthalate, polyethylene terephthalate, polycarbonate, polyketone, polyester, polyethylene, polyetheretherketone, polyetherimide, polysulfone, polyimide, polyphenylene, polysulfone, polyvinyl chloride, polyvinylidene chloride, thermoplastics, elastomers, and combinations thereof. In particular, a suitable polyacetal is Hostaform® C9021 from Ticona GmbH.

| Parts List | |
|---|---|
| Shaving apparatus | 100 |
| Handle | 102 |
| Elongated structure | 104 |
| Interior surface | 106 |
| Exterior surface | 108 |
| First opening | 110 |
| Proximate end | 112 |
| Distal end | 114 |
| Opening | 116 |
| Groove | 118 |
| Opening | 120 |
| Sleeve | 200 |
| Interior surface | 202 |
| Exterior surface | 204 |
| Protrusion | 206 |
| Groove | 208 |
| Groove | 210 |
| Cartridge support structure | 300 |
| Proximate end | 302 |
| Distal end | 304 |
| Top portion | 306 |
| Bottom portion | 308 |
| Recess | 310 |
| Rib | 312 |
| Rib | 314 |
| Connecting assembly | 400 |
| Bearing button | 402 |
| Movable member | 404 |
| Bracket | 406 |
| Cam follower | 408 |
| Spring | 410 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular implementations of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a razor handle comprising:

(a) providing an at least partially hollow elongated structure, the elongated structure having an interior surface, an exterior surface, a first opening at a proximate end, and a second opening along a length of the elongated structure, the second opening extending from the interior surface to the exterior surface; and (b) providing, within said elongated structure, an at least partially hollow sleeve having an interior surface and an exterior surface comprising a protrusion, wherein the protrusion extends through the second opening to the exterior surface of the elongated structure thereby forming a gripping member, wherein, at the first opening, the proximate end of the elongated structure is adapted to separably engage a proximate end of a cartridge support structure.

2. The method of claim 1, wherein the sleeve is formed by injection molding a polymeric material into the first, the second, or an additional opening of the elongated structure.

3. The method of claim 2, wherein the additional opening is at a distal end of the elongated structure.

4. The method of claim 1, wherein the at least partially hollow sleeve comprises an elastomeric material.

5. The method of claim 1, wherein the proximate end of the cartridge support structure includes a rib that engagably mates with a corresponding groove on one of the surfaces of the elongated structure.

6. The method of claim 5, wherein the corresponding groove is located within the at least partially hollow sleeve.

7. The method of claim 1, wherein joining the elongated structure with the cartridge support structure renders the handle impervious to liquid.

8. A method of making a razor comprising:

providing an at least partially hollow elongated structure having an interior surface and an exterior surface, the elongated structure further comprising a first opening at a proximate end; a second opening along a length of the elongated structure, the second opening extending from the interior surface to the exterior surface;

providing, within said at least partially elongated structure, an at least partially hollow sleeve having an interior surface and an exterior surface comprising a protrusion, wherein the protrusion extends through the second opening to the exterior surface of the elongated structure thereby forming a gripping member; and providing a cartridge support structure having top and bottom portions, and proximate and distal ends, whereby the proximate end of the cartridge support structure is adapted to engagably mate with the proximate end of the elongated structure at the first opening and wherein the distal end of the cartridge support structure being adapted for releasably engaging a razor cartridge.

9. The method of claim 8, further providing a connecting assembly for engaging or disengaging the razor cartridge, wherein the connecting assembly is located between the top and bottom portions.

10. The method of claim 9, wherein the connecting assembly includes movable members whereby in a first position the movable members move toward each other permitting disengagement with the razor cartridge and whereby in a second position the movable members move away from each other permitting engagement with the razor cartridge.

11. The method of claim 10, wherein the connecting assembly is adapted to releasably engage the movable members by receiving a predetermined force from the razor cartridge thereby releasing the movable members to the second position for engagement with the razor cartridge.

12. The method of claim 8, wherein the at least partially hollow sleeve comprises an elastomeric material.

13. The method of claim 8, wherein the proximate end of the cartridge support structure includes a rib that engagably mates with a corresponding groove on one of the surfaces of the elongated structure.

14. The method of claim 8, wherein the top portion of the cartridge support structure is removably attached.

15. The method of claim 8, wherein the elongated structure engagably mates with the top portion.

16. The method of claim 8, wherein the cartridge support structure is ultrasonically welded to the elongated structure.

17. The method of claim 8, wherein the sleeve is formed by injection molding a polymeric material into the first, the second, or an additional opening of the elongated structure.

* * * * *